US007980288B2

(12) United States Patent
Judkins

(10) Patent No.: US 7,980,288 B2
(45) **Date of Patent: *Jul. 19, 2011**

(54) VERTICAL BLIND HAVING A FACE OF PARALLEL THREADS

(76) Inventor: Ren Judkins, Pittsburgh, PA (US)

( * ) Notice: Subject to any disclaimer, the term of this patent is extended or adjusted under 35 U.S.C. 154(b) by 760 days.

This patent is subject to a terminal disclaimer.

(21) Appl. No.: 10/913,870

(22) Filed: Aug. 6, 2004

(65) Prior Publication Data

US 2005/0006034 A1 Jan. 13, 2005

Related U.S. Application Data

(63) Continuation-in-part of application No. 10/364,153, filed on Feb. 11, 2003, now Pat. No. 6,772,815.

(51) Int. Cl.
*E06C 1/00* (2006.01)

(52) U.S. Cl. ..... 160/168.1 V; 160/166.1

(58) Field of Classification Search ..... 160/84.05, 160/84.04, 89, 166.1, 178.3, 332, 176.1 R, 160/177 R, 236, 121.1, 168.1, 108, 113, 114, 160/123, 127, 237; 442/203; 137/384 A; D6/575; 428/116

See application file for complete search history.

(56) References Cited

U.S. PATENT DOCUMENTS

| | | | | | |
|---|---|---|---|---|---|
| 1,492,544 | A | | 4/1924 | Hough | |
| 3,224,490 | A | * | 12/1965 | Toti et al. | 160/168.1 R |
| 3,366,161 | A | * | 1/1968 | Barnett | 160/368.1 |
| 3,384,519 | A | | 5/1968 | Froget | |
| 3,490,515 | A | * | 1/1970 | Kandel | 160/178.1 R |
| 3,814,364 | A | * | 6/1974 | Gargaro | 248/210 |
| 3,851,699 | A | * | 12/1974 | Shapiro | 160/168.1 V |
| 4,019,554 | A | * | 4/1977 | Rasmussen | 160/84.02 |
| 4,915,153 | A | * | 4/1990 | Toti | 160/84.04 |
| 5,095,966 | A | * | 3/1992 | Rogers | 160/168.1 R |
| 5,313,999 | A | | 5/1994 | Colson et al. | |
| 5,339,882 | A | | 8/1994 | Judkins | |
| 5,394,922 | A | * | 3/1995 | Colson et al. | 160/121.1 |
| 5,404,831 | A | * | 4/1995 | Miller | 114/306 |

(Continued)

OTHER PUBLICATIONS

Modern Language Association (MLA): "thread." Online Etymology Dictionary. Douglas Harper, Historian. Jun. 4, 2010. <Dictionary.com http://dictionary.reference.com/browse/thread>.*

*Primary Examiner* — Katherine Mitchell
*Assistant Examiner* — Candace L Bradford
(74) *Attorney, Agent, or Firm* — Buchanan Ingersoll & Rooney PC

(57) ABSTRACT

A window covering has a transparent front face and optional transparent back face, either or both of which are formed from a series of spaced apart parallel threads, and a series of vanes attached to the faces. The parallel threads which form the front face and optional back face are spaced apart an amount which allows light to readily pass while providing a soft fabric like appearance. The vanes have a light filtering or light impeding property and may be opaque. The front and back longitudinal edges of each slat are respectively attached to the front face and any back face that is present. The resulting structure, when combined with a hardware system, is a light control blind. Movement of the vanes from a position perpendicular to the front face and any back face to a position generally parallel to the front controls the amount of light which is admitted through the window covering. An additional layer of fabric may be provided opposite the front face or the back face.

11 Claims, 6 Drawing Sheets

U.S. PATENT DOCUMENTS 5,542,463 A * 8/1996 Pinkalla et al. ..... 160/273.1
5,638,881 A 6/1997 Ruggles
5,664,613 A * 9/1997 Jelic ..... 160/84.05
5,753,338 A * 5/1998 Jelic et al. ..... 428/116
5,806,579 A * 9/1998 Judkins ..... 160/168.1 R
5,890,560 A * 4/1999 Sloop ..... 182/107
6,089,350 A * 7/2000 Hankins ..... 182/107
6,105,911 A * 8/2000 Olexson ..... 248/211
6,158,549 A * 12/2000 Hartman, Jr. ..... 182/45
6,164,363 A * 12/2000 Colson et al. ..... 160/84.05
6,397,920 B1 * 6/2002 Forin ..... 160/238
6,484,786 B1 11/2002 Ruggles et al.
D473,743 S * 4/2003 Judkins ..... D6/575
6,550,577 B1 * 4/2003 Allgire ..... 182/107
6,722,469 B1 * 4/2004 Weger, Jr. ..... 182/107
6,772,815 B1 * 8/2004 Judkins ..... 160/84.05
7,222,655 B2 * 5/2007 Toti ..... 160/89
7,445,086 B1 * 11/2008 Sizemore ..... 182/107
7,743,886 B2 * 6/2010 Feemster et al. ..... 182/107
2003/0114055 A1 * 6/2003 Burton et al. ..... 442/31
2003/0186606 A1 * 10/2003 Sutherland et al. ..... 442/301
2004/0113528 A1 * 6/2004 Wang ..... 312/3
2005/0252720 A1 * 11/2005 Chant et al. ..... 182/127
2006/0000674 A1 * 1/2006 McIntire et al. ..... 182/129

* cited by examiner 7
9
10
19
2
3
6
5

VERTICAL BLIND HAVING A FACE OF PARALLEL THREADS

CROSS REFERENCE TO RELATED APPLICATION

This application is a continuation-in-part of U.S. patent application Ser. No. 10/364,153, filed Feb. 11, 2003, now U.S. Pat. No. 6,772,815.

FIELD OF INVENTION

The invention relates to vertical blind type window coverings and particularly to a window covering having vertical vanes that travel on an overhead track and are connected to one or two faces of material through which light may pass.

BACKGROUND OF THE PRIOR ART

Venetian blinds are well-known window coverings. They have a series of horizontal slats hung from ladders which extend between a headrail and a bottomrail. The slats can be rotated between an open, see through position and a closed position. Additionally, the blinds can be raised and lowered. Venetian blinds contain aluminum, plastic, fabric or wood slats and are available in a wide range of colors.

Another type of window covering, called a vertical blind, has a series of vertical vanes that travel on an overhead track. The vanes can be rotated in much the same way that the slats of a venetian blind are rotated. Some vertical blinds also have a panel of fabric through which light may pass that is attached to one edge of the vanes. The fabric will extend over the window when the vanes have fully traversed the overhead track. Typically, the fabric is a sheer or open weave material which allows light to pass. A second panel of fabric may be attached to the opposite edge of the vanes.

Fabric window coverings and draperies are often preferred by consumers over venetian blinds and vertical blinds because they have a softer, warmer appearance. However, draperies do not have the ability to control the amount of light transmitted through the window covering in a manner similar to louvered blinds like the traditional venetian blind and vertical blind.

Several attempts have been made to provide a fabric window covering with the ability to control the amount of light entering the room. Shapiro in U.S. Pat. No. 3,851,699 discloses a window draw drape having spaced apart light impeding and light transmitting vertical sections. The light impeding sections can be rotated to cover all or portions of the light admitting sections. The light impeding sections are vertical slats attached to the drapery or tightly woven fabric. The light admitting sections are open mesh. This product is difficult to operate because the light impeding sections tend not to align with the light admitting portions when those sections are rotated.

In U.S. Pat. No. 5,313,999 to Colson et al. there is a window covering having first and second parallel sheer fabric sides and a plurality of light impeding or somewhat light impeding vanes extending between the sheer fabric sides. The vanes are angularly controllable by relative movement of the sheer fabric sides. Like the combination of a sheer fabric and a light impeding fabric this system allows the user to have a fully open window, a sheer covered window allowing light transmission with day time privacy, and a more opaque covering providing night time privacy or room darkening. In addition, it the has intermediate light control of a louvered product like venetian blinds. The Colson window covering system is difficult to manufacture and to fabricate, has a limited range of fabrics it can use, and has a very flat appearance when in the light impeding mode. Another problem with this window covering is that a moire appearance often occurs on the front face of the window covering as a result of an alignment between the weave pattern of the front sheet and the weave pattern of the rear sheet. When this window covering is attached to a roller, the material tends to crumple or wrinkle when rolled up. The material is also hard to cut and the cut edges are difficult to seal because of the sheer fabrics that must be used.

Another light control window covering system is disclosed in U.S. Pat. No. 3,384,519 to Froget. The window covering disclosed there consists of two cloth layers spaced apart by movable parallel blades having each of their marginal edges heat welded to one of the movable cloth layers. Froget's welding uses the material present which is very thin in order to be see-through, flexible, and store well. It is difficult to precisely apply heat and pressure to sufficiently bond these layers without damaging them by melting through the layer or forming warp spots. With this window covering relative movement of the two cloth layers in a direction perpendicular to the blades changes the angle of the blade and thus controls the amount of light passing through the article. Because the blades must be heat welded to the cloth layers, only thermoplastic materials can be used. Also, heat welding necessarily requires a melting of some of the fibers of the material bonded, thus providing an uneven outer appearance along the heat welds and producing unwanted crimps or creases of the material which can result in fatigue failure. Furthermore, heat welding is a relatively slow process and the resulting weld is limited in strength. The window covering material in the Colson and Froget blinds is tilted and stored on a roller wrapping successively around itself. When the layer is displayed over the window the front layer is the same length as the back layer. When the layers are stored around the roller each layer travels a progressively larger or longer path, the difference depending on the thickness of each fabric. Since all the layers are bonded together the wrapping can cause wrinkling on the layers traveling on the inside or shorter paths. Having very uniformly thin layers helps mitigate this problem, but requiring thin layers limits the variations of the weave, yarns, style and other fabric features that can be chosen.

In my U.S. Pat. No. 5,339,882, I disclose a window covering having a series of slats connected between two spaced apart sheets of material. The slats are substantially perpendicular to the sheets of material when the covering is in an open position. The slats are substantially parallel to the first and second sheets of material when the window covering is in a closed position. This product has many of the same limitations of the window covering disclosed by Colson and Froget. All these products use sheets of fabric and have all the problems associated with fabric sheets.

In U.S. Pat. No. 5,753,338 Jelic et al. disclose a honeycomb material for window coverings in which the front face, back face and slats are interwoven simultaneously. This process uses an improved warp knitting technique in which a front mesh and a rear mesh are provided and warp threads are woven through them. The two meshes are maintained parallel to one another. At selected intervals slats are woven between the two meshes to form a honeycomb structure. Since the warp threads weave back and forth between meshes, it would seem almost impossible for the slat to have a greater density than the "faces." Secondly, since the material is created with the slats being perpendicular to the meshes, the slats must bend to affect the closure, but they have no hinge portion. This window covering has not been commercialized, but one would expect it to have the same problems as the window covering disclosed by Colson.

A problem with these fabric structures is that they must be very precisely made to look and function properly. But, textiles are inherently inconsistent and unprecise due to the nature of the weaving, printing and coating processes. Changes in temperature and humidity cause fabric to expand and contract. If a sheet of fabric is hung between a headrail and a bottomrail, a change in temperature or humidity may cause the edges of the fabric to move inward. Such movement is severely restrained near the headrail and the bottomrail, but can more easily occur around the center of the fabric. Consequently, the fabric sheet will assume an hourglass shape. For many fabrics this hourglass appearance is quite noticeable, particularly for longer shades. One way in which the art has been able to address this problem is to avoid using many fabrics for window coverings that will be subject to wide ranges of temperature and humidity. Some fabrics can be coated with starch or other chemicals to prevent shrinkage. But, that treatment increases costs.

There is a need for a window covering system which provides the light control of a venetian blind and a vertical blind with the soft appearance of draperies and pleated shades. This window covering should be available in a wide variety of fabric, colors and styles. The window covering should not be adversely affected by changes in temperature and humidity. The window covering should be able to be easily cut down from standard sizes and to be otherwise easy to fabricate. The system should be simple to install and to operate and able to be manufactured at a cost which allows the product to be sold at a competitive price. Furthermore, the window covering should not suffer from the moire effect that has plagued the window coverings which have two parallel sheets of light transmissive material. Finally, the window covering should be easy to clean and maintain.

SUMMARY OF THE INVENTION

I provide a light controllable window covering in which there is a transparent front face formed from a series of spaced apart parallel threads. One may also provide a back face made from knitted or woven material or the back face could also be a series of spaced apart parallel threads. A series of vanes or slats are attached to the front face and to any back face that is provided. In a vertical blind the vanes travel on an overhead track as in conventional vertical blinds. The front longitudinal edge of each vane or slat is attached to the front face and the rear longitudinal edge of each slat is attached to the back face, if present. The resulting structure, when combined with a hardware system, is a light control window covering.

The parallel threads which form the front face are spaced apart from one another an amount which allows light to readily pass while providing a soft fabric like appearance. Consequently, movement of the light impeding slats from a position perpendicular to the front face to a position generally parallel to the front face controls the amount of light which is admitted through the window covering.

The vanes or slats can be made from plastic, metal, or even wood or a composite material and can be covered with fabric. The vanes or slats may also be a fabric or film. The vanes or slats may or may not allow light to pass through them.

Other objects and advantages of the invention will become apparent from a description of certain present preferred embodiments shown in the drawings.

DESCRIPTION OF THE PREFERRED EMBODIMENTS

Figure 1:
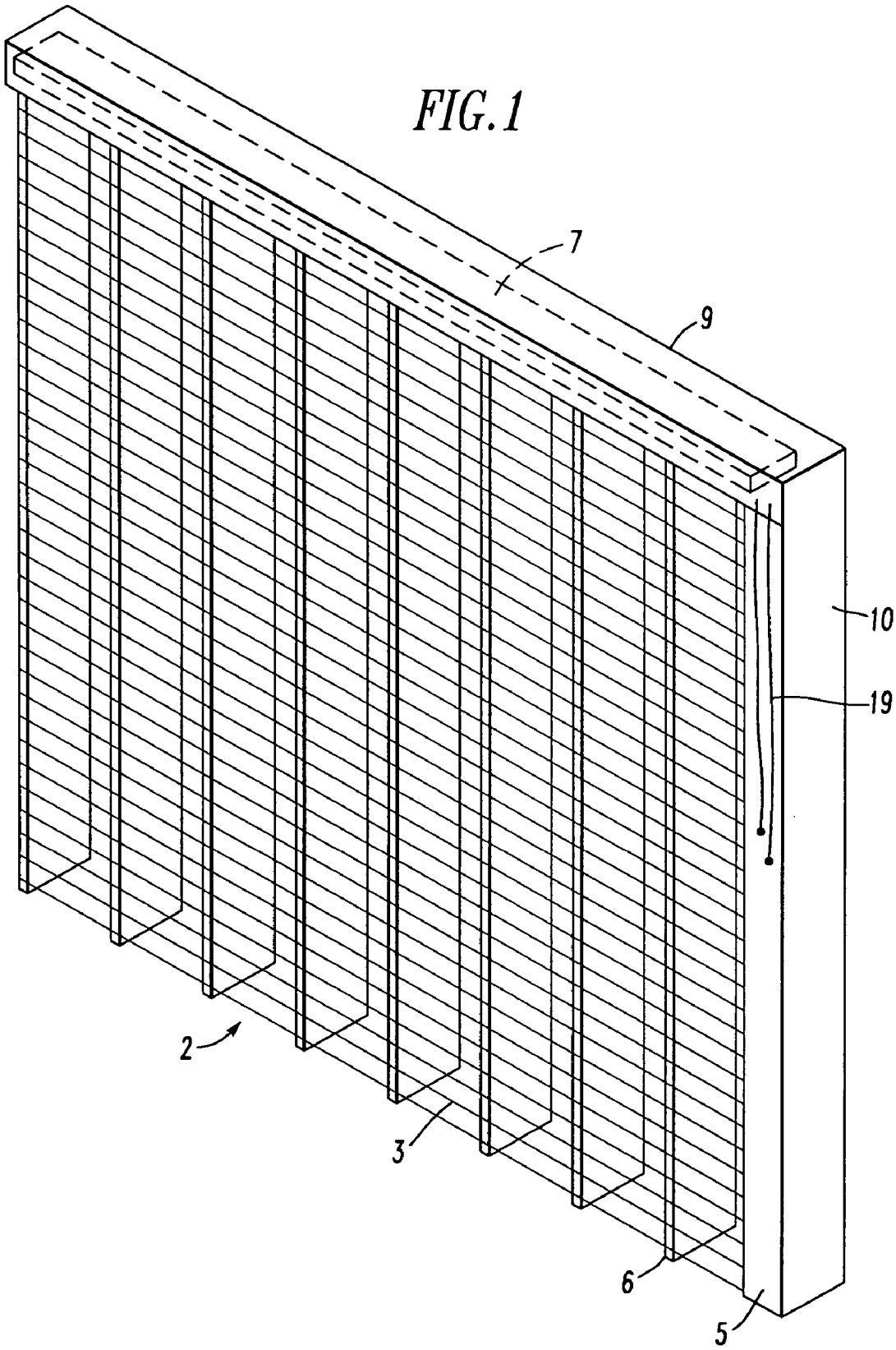
FIG. 1 is a perspective view of a first present preferred embodiment of my window covering contained as a vertical blind having only a front face and in a fully extended open position.
Figure 2:
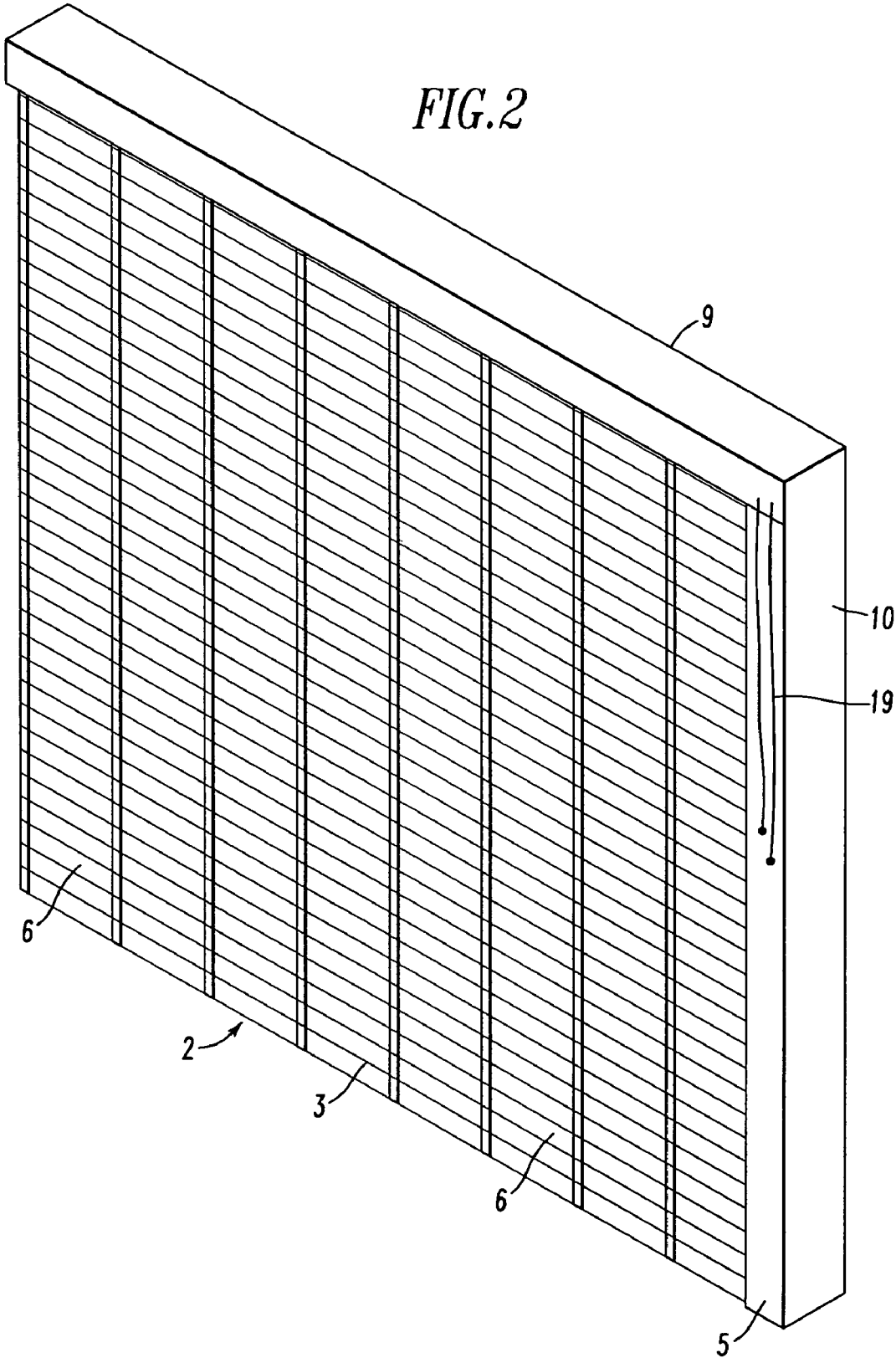
FIG. 2 is a perspective view of the window covering of FIG. 1 in a fully extended closed position.
Figure 3:
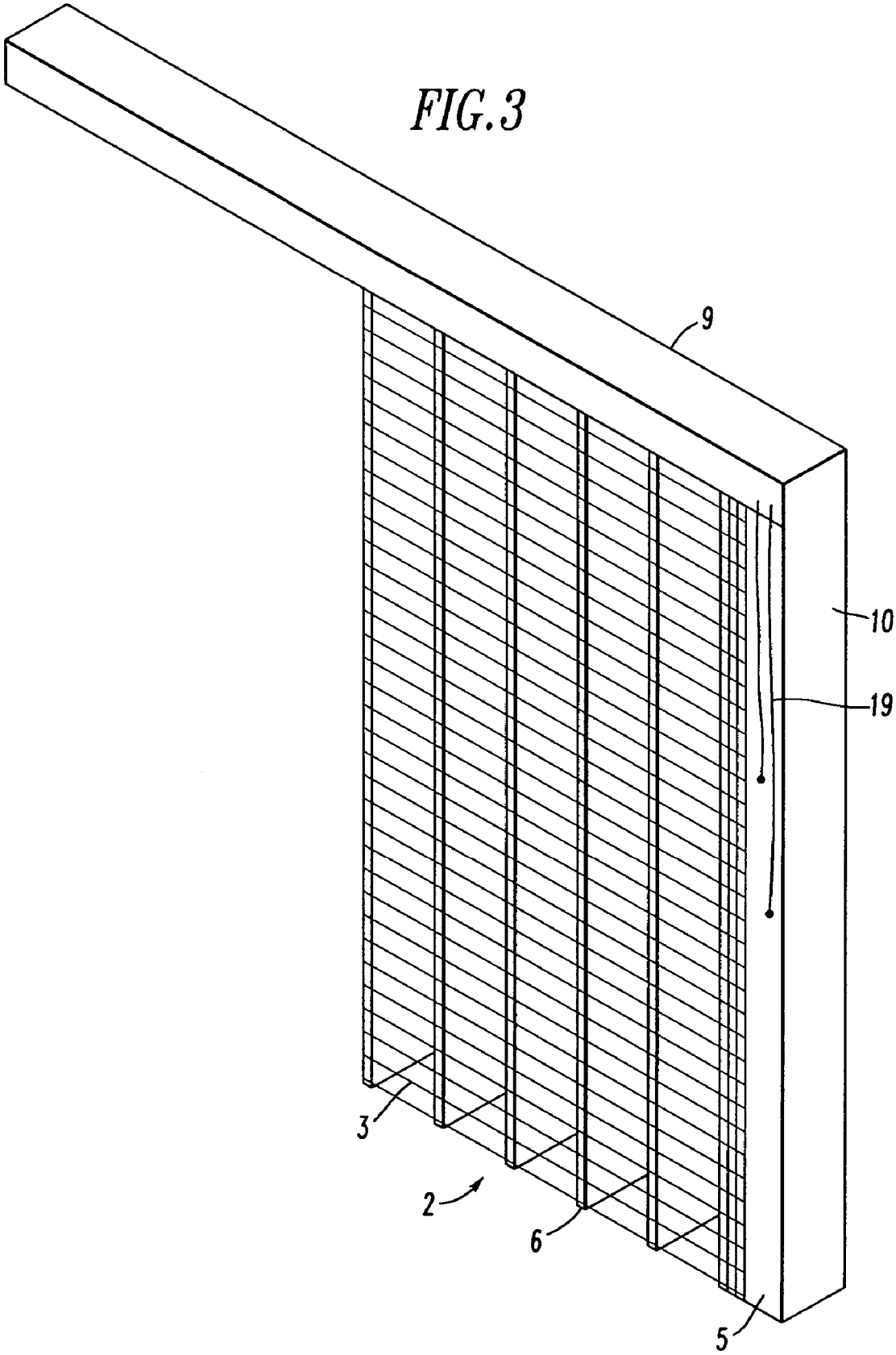
FIG. 3 is perspective view of the window covering shown in FIG. 1 in a partially retracted open position.

A first present preferred embodiment of my light control window covering configured as a vertical blind 1 shown in FIGS. 1, 2 and 3 has a front face 2 of parallel threads and a series of vanes 6 connected to the parallel threads. The vanes may be flexible or rigid. When embodied in a vertical blind, the vanes 6 extend from and ride on a track 7, indicated in dotted line, within housing 9. Any conventional track system used to support vanes in a vertical blind which is known in the art can be used. In this embodiment, the front face is a series of spaced apart parallel warp threads 3. There is a sufficient distance between adjacent threads to allow light to readily pass through the front face. The spacing preferably is from 0.080 to 0.25 inches. However, to make the threads easily visible a greater spacing is shown in the figures. In this embodiment, there are no cross threads, or weft threads, intersecting the parallel threads. If desired, some cross threads can be provided, but the number of cross threads should not be more than one tenth as many as the parallel threads in the face. An advantage to using only warp threads, or using warp threads with relatively few weft threads, is that the warp threads can move toward and away from one another into the space between adjacent vanes. Consequently, the threads can assume a sine wave shape when the window covering is partially retracted as in FIG. 3 In the preferred embodiment of FIGS. 1, 2 and 3 an end piece 10 is provided on one side of the blind. This end piece may have a front panel 5 behind which the vanes may go when they are retracted. In FIG. 2 a portion of one vane is behind panel 5. In FIG. 3 three of the vanes are adjacent the front panel 5. For some installations the end piece 10 and front panel 5 may be eliminated. In that event housing 9 would be mounted to the ceiling. Yet another option is to provide a second end panel (not shown) at the opposite end of housing 9. The use of parallel threads increases transparency so that another more, decorative, layer that may not be connected to the front face can be placed in front of the blind. Yet, another advantage of a parallel thread layer is that the vanes can more easily be cleaned. A vacuum brush run over the face of the window covering can pull dust or bugs from the vanes, between the parallel threads and into the vacuum cleaner.

The vertical window blind here disclosed may be opened and closed by cords or a motor as in conventional vertical blinds. In the embodiment of FIGS. 1 through 3, cords 19 are used to turn the vanes 6 from the open position shown in FIG. 1 to the closed position of FIG. 2. The same cords are also used to advance and retract the blind. As in conventional vertical blinds, pulling on one cord 19 moves the vanes from the closed position of FIG. 2 to the open position of FIG. 1 and continued pulling advances or retracts the blind along the track.

Figure 4:
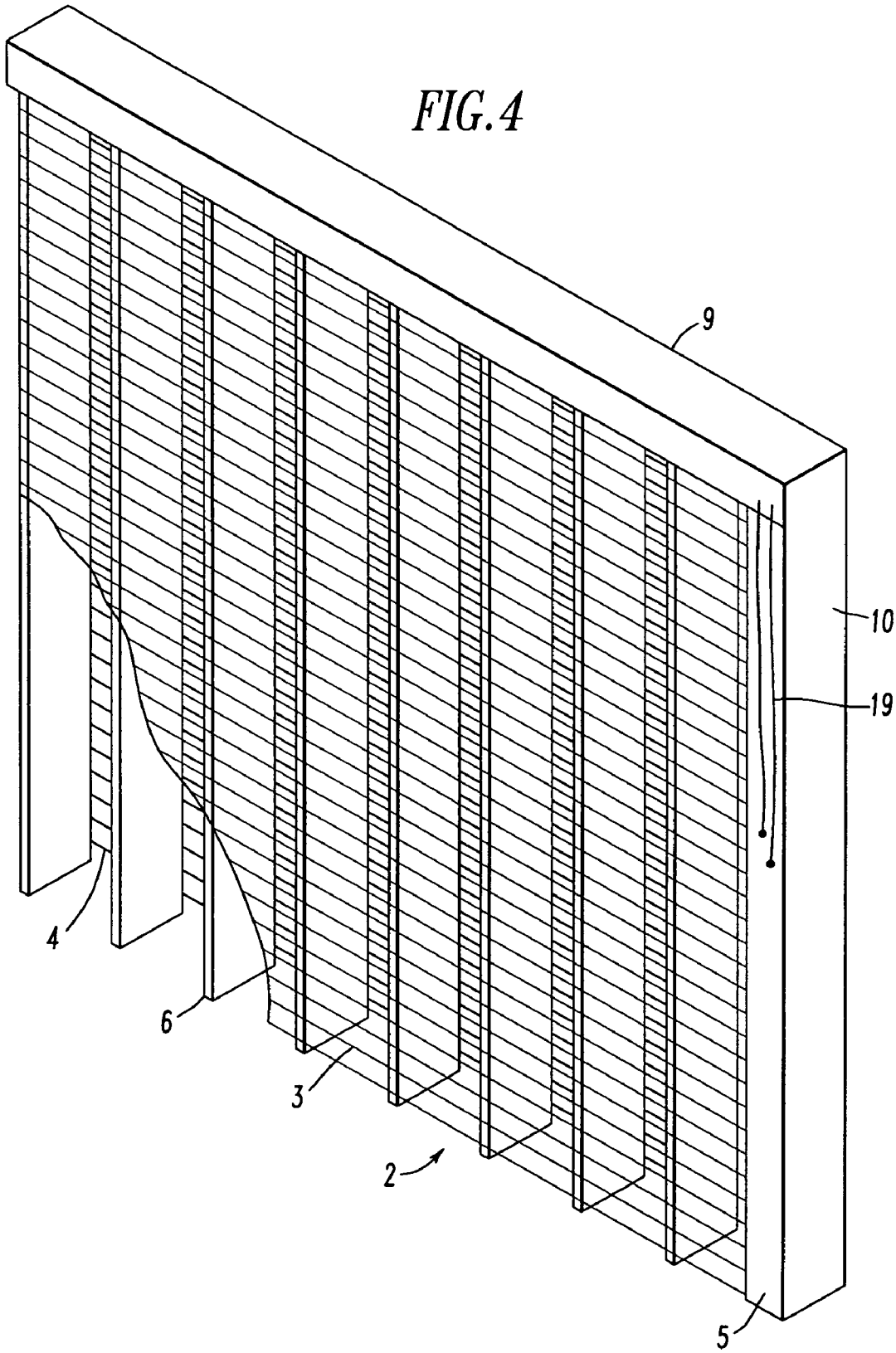
FIG. 4 is a perspective view of a second present preferred embodiment of my window covering configured as a vertical blind having both a front face and a back face and in a fully extended open position.

A second present preferred embodiment shown in FIG. 4 is similar to the first embodiment but also has a back face 4 of parallel threads. This back face is similar in construction to the front face. The threads in the back face may or may not be the same material as the threads in the front face.

In another embodiment of the present window covering, either the front face 2 or the back face 4 may be knit or woven material which permits passage of light through the material. A series of vanes or slats which may be opaque or nearly opaque are attached to either or both of the front and back faces by adhesives or welding using any conventional attachment method. These vanes enable the user to have a variable range of light pass through the window covering. The upper end of the range may just be a translucent level of light or it might be a black out. In most embodiments the vanes or slats likely will be semi-opaque and filter rather than block the light. These vanes or slats could be fabric, film or plastic or a composite of one or more of these materials.

Figure 5:
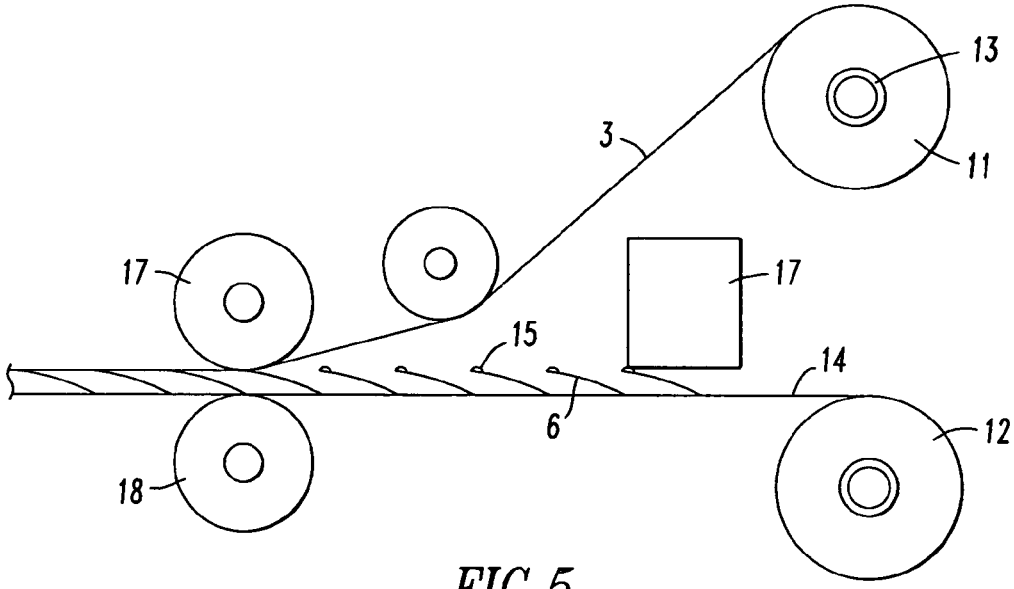
FIG. 5 is a diagram of a preferred method of making the window covering having both a front face and a back face such as in the vertical blind shown in FIG. 4.

As shown in FIG. 5 I prefer to form the embodiment of FIG. 4 in manner similar to the process disclosed by Froget in U.S. Pat. No. 3,384,519. Two supply rolls 11 and 12 are provided. One roll 11 contains a series of threads, 3 each thread wound in a separate coil on the roll 13. The second supply roll 12 may be identical to the first roll 11 or it may be a knit fabric 14 or woven material wound on a roller. A series of vanes or slats 6 are placed on the advancing fabric 14 from supply 17. One edge of each vane is bonded to the fabric 14. The opposite edge of the vane is bonded to the parallel threads. In a preferred embodiment the vanes 6 are first attached to the fabric 14. A glue line 15 is placed on the edge of the vane which is away from the fabric. The parallel threads 3 are fed over a grooved roller 16. Then the parallel threads 3, fabric 14 and vanes are passed between rollers 17 and 18 where the threads 3 are attached to the slats. In one embodiment the adhesive 15 is melted by heated rollers 17 and 18. In another embodiment a two part adhesive is used. One part forms the glue line 15 and the other part is applied to the threads. Glue line 15 need not extend the full length of the vanes, but could be a series of spaced apart droplets or short lines of adhesive. Thermoplastic ribs can be added to the edges of the vanes to increase the amount of material available for welding onto the warps and also to enhance the rigidity of the vanes on the edges so that there can be a longer span between warp threads.

The threads which form the front and back faces preferably will be a polyester but can be any type of thread that has been used in window covering fabrics. The vanes may be plastic, metal, wood or a composite material and may or may not be covered with fabric. To bond the threads to the vanes one could use a copolyester hot melt adhesive which is tacky at a lower temperature, typically around 220° F., and melts and flows at a higher temperature, usually around 350° F. While the adhesive is tacky the vanes can be easily positioned. When properly positioned the temperature can be raised to melt the adhesive and then quickly cooled to complete the bond.

Figure 6:
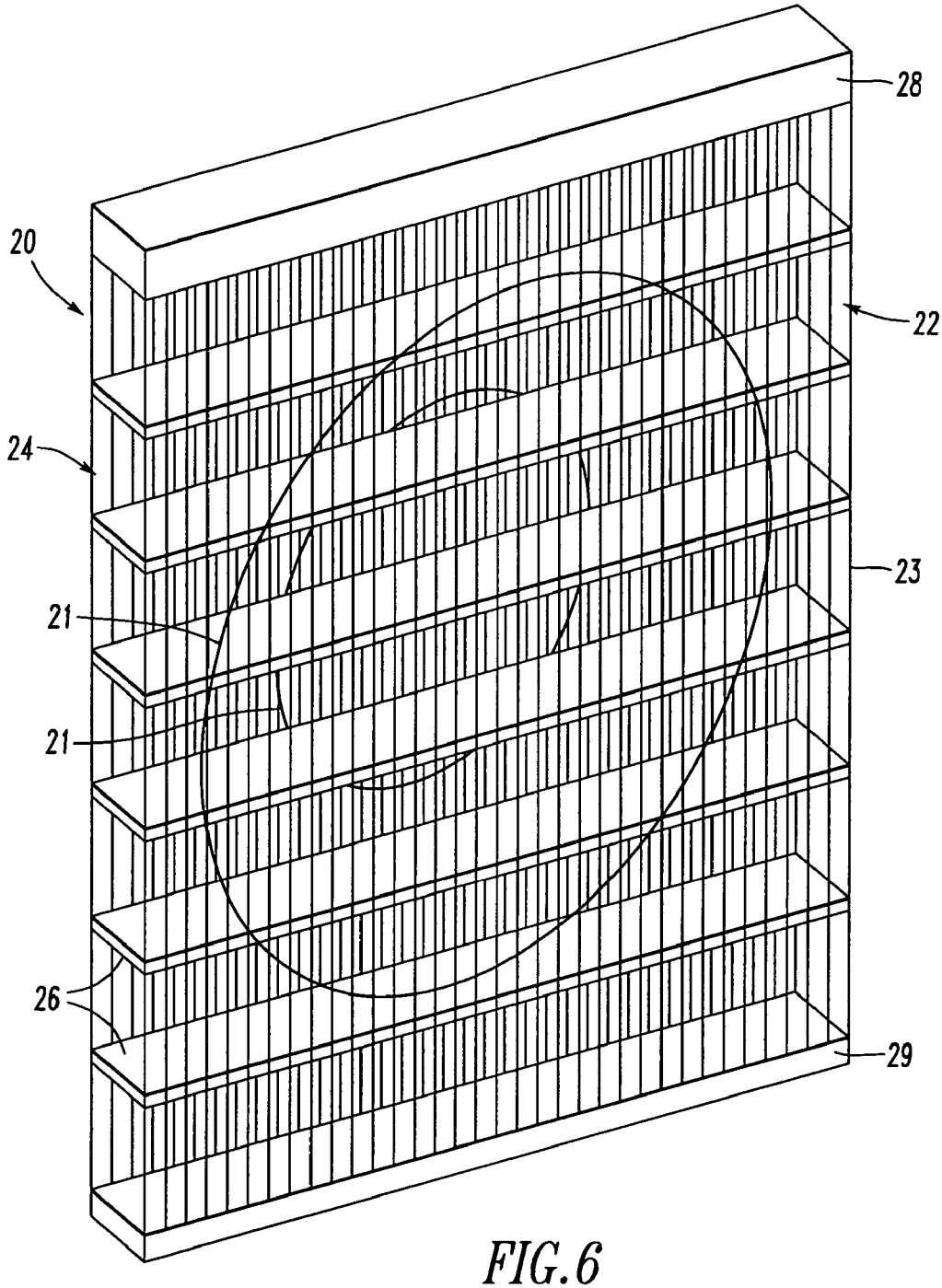
FIG. 6 is a perspective view of a third present preferred embodiment of my window covering configured as a horizontal or venetian blind having cross threads that form a decorative pattern.

The use of parallel threads in the front face and the back face prevent the appearance of a moiré pattern which is caused by a misalignment of two sheets of light transmissive fabric having the same or similar weave. If desired one could provide a series of widely spaced apart cross threads or weft threads through the parallel threads to create a pleasing design or pattern as shown in the horizontal blind in FIG. 6. This blind 20 has a front face 22 and rear face 24 of parallel threads 23 that extend between headrail 28 and bottomrail 29. Slats 26 are attached between the two faces 22 and 24. Weft threads 21 are woven through the parallel threads to create a circle design. If cross threads are used, the cross threads must not be so frequent as to create a woven material. Indeed, the number of cross threads should never be more than one-tenth of the number of parallel threads. A single thread which crosses back and forth across the parallel warp threads would be considered as a separate cross thread each time that it crosses the warp threads. If a large number of cross threads are provided in both the front face and the back face, then there likely will be the moiré effect that this window covering is designed to avoid. Cross threads affect the cutting for width, the transparency, the moire, but mostly the manufacturability of the product, since knitted goods lack dimensional consistency as do woven sheers in wide widths. Not having cross threads is less costly, saving machine time and material.

One could provide an additional layer of window covering material adjacent either the front face or rear face. That additional layer would be mounted on or adjacent to housing 9. Any material suitable for use as a window covering could be used for the additional layer. Consequently, the front layer could be any color or texture and have any weave or pattern. Cost is always a concern. In the present preferred embodiments the vertical blind can be made of a relatively inexpensive material while the additional layer can be more expensive fabric.

In all the embodiments one can clean vanes through the front face of parallel warp threads. Any additional layer could easily be retracted or rolled-up to allow access through the layer of parallel warp threads. The present invention minimizes thickness of front and back faces that are attached to the vanes, minimizes visual contributions of faces and increases transparency. In the present window covering the vane or slat is a more dominant visual component for color and texture. The faces of the present blind are so thin, inexpensive and transparent that an additional layer of decorative material can be added in the front. It is also easier to cut across the width of a layer without fraying or welding adjacent layers.

In describing the preferred embodiments the terms front face and back face have been used to distinguish the faces of the vertical blind. It should be understood that when the vertical blind is attached to the headrail or placed over a window opening, either face may be facing the window. Consequently, front face is not limited to the room side of the window covering and back face is not limited to the side of the window covering nearest the window.

It should be understood that the terms vanes and slats are used to identify the parallel structures attached to the front face and to any back face that may be present. The vanes or slats may be oriented vertically or horizontally unless otherwise specified.

Although I have shown several present preferred embodiments of my window covering, it should be distinctly understood that the invention is not limited thereto but may be variously embodied within the scope of the following claims.

I claim:

1. A vertical blind comprised of a plurality of vanes hung from a track and a front face comprised of a plurality of parallel threads attached to the vanes, the threads spaced apart a sufficient amount so as to allow light to pass through the front face, the front face having no cross threads intersecting the plurality of parallel threads and each vane being movable about a longitudinal axis through the vane from an open position, in which the longitudinal edges of adjacent vanes are spaced apart from one another to allow light to pass between the adjacent vanes, to a closed position in which longitudinal edges of adjacent vanes abut one another to block light from passing between adjacent vanes.

2. The vertical blind of claim 1 also comprising a back face comprised of a plurality of parallel threads attached to the vanes, the parallel threads of the back face being spaced apart a sufficient amount so as to allow light to pass through the back face.

3. The vertical blind of claim 2 also comprising at least one cross thread woven through the parallel spaced threads of the back face, the number of cross threads being not more than one tenth as many as the plurality of parallel threads in the back face.

4. The vertical blind of claim 2 wherein the plurality of parallel threads in the back face are spaced apart a distance from 0.08 inches to 0.25 inches.

5. The vertical blind of claim 2 also comprising cross threads in the back face.

6. The vertical blind of claim 5 wherein the cross threads in the back face and the spaced apart parallel threads of the back face form a knit material or a woven material.

7. The vertical blind of claim 1 wherein the vanes are comprised of a material selected from the group consisting of fabrics, films, woods, metals, plastics, and composite materials.

8. The vertical blind of claim 1 also comprising at least one end panel adjacent the track, and generally parallel to the vanes.

9. The vertical blind of claim 1 wherein the plurality of parallel threads in the front face are spaced apart a distance from 0.08 inches to 0.25 inches.

10. A vertical blind comprised of a plurality of vanes hung from a track and a front face comprised of a plurality of parallel threads attached to the vanes, the threads spaced apart a sufficient amount so as to allow light to pass through the front face, the front face having at least one cross thread woven through the parallel spaced threads in the front face, the number of cross threads being not more than one tenth as many as the plurality of parallel threads in the front face and each vane being movable relative about a longitudinal axis through the vane from an open position, in which the longitudinal edges of adjacent vanes are spaced apart from one another to allow light to pass between the adjacent vanes, to a closed position in which longitudinal edges of adjacent vanes abut one another to block light from passing between adjacent vanes.

11. The vertical blind of claim 10 wherein the at least one cross thread forms a decorative pattern.

* * * * *